US005419455A

United States Patent [19]

Russeau

[11] Patent Number: 5,419,455

[45] Date of Patent: May 30, 1995

[54] PLATE FOR USE WITH STEMWARE

[76] Inventor: Kathleen Russeau, 1439 Oakbrook East, Rochester Hills, Mich. 48307-1127

[21] Appl. No.: 239,721

[22] Filed: May 9, 1994

[51] Int. Cl.[6] ..... B65D 21/00

[52] U.S. Cl. ..... 220/575; 220/23.83; 206/562; 206/564

[58] Field of Search ..... 220/575, 574, 23.83; 206/562, 564

[56] References Cited

U.S. PATENT DOCUMENTS

| | | | |
|---|---|---|---|
| D. 227,851 | 7/1973 | Nowland et al. . | |
| D. 322,197 | 12/1991 | Sherlin . | |
| D. 331,860 | 12/1992 | Stanfield . | |
| 774,479 | 11/1904 | Lange . | |
| 2,916,180 | 12/1959 | Alger . | |
| 3,955,672 | 5/1976 | Brundage . | |
| 4,516,685 | 5/1985 | French . | |
| 4,607,758 | 8/1986 | Stevens . | |
| 4,860,895 | 8/1989 | Iaslovits . | |
| 4,938,373 | 7/1990 | McKee . | |
| 4,961,555 | 10/1990 | Egan, Jr. | 220/23.83 X |
| 5,058,737 | 10/1991 | Patterson . | |
| 5,060,820 | 10/1991 | Boerner . | |
| 5,085,391 | 2/1992 | Berger et al. | 220/23.83 X |
| 5,110,170 | 5/1992 | Boatright . | |
| 5,111,960 | 5/1992 | Zilliox . | |
| 5,114,038 | 5/1992 | Quensen . | |
| 5,170,908 | 12/1992 | Austin . | |
| 5,176,283 | 1/1993 | Patterson et al. . | |
| 5,184,750 | 2/1993 | Moller | 220/23.83 X |
| 5,207,743 | 5/1993 | Costarella et al. . | |
| 5,234,125 | 8/1993 | Roberts . | |
| 5,294,000 | 3/1994 | Yanuzzi | 220/575 X |

*Primary Examiner*—Steven M. Pollard

*Attorney, Agent, or Firm*—Reising, Ethington, Barnard, Perry & Milton

[57] ABSTRACT

A plate (12) for use with stemware (14) that has a center portion (16) and an outer periphery (24) with a notch (28) therethrough that lead to an aperture (30) that passes through the plate. The aperture is substantially surrounded by a rim (32) that is coplanar with the upper edge of the periphery and a lower lip (36) that is coplanar with the central portion. A base foot (20) is under the central portion and elevates the lip to allow a stemware foot flange (58) to fit under the lip when the stem and plate are seated flat on a table surface (19).

20 Claims, 3 Drawing Sheets

PLATE FOR USE WITH STEMWARE

TECHNICAL FIELD

The field of this invention relates to plates and stemware for use during social receptions.

BACKGROUND OF THE DISCLOSURE

At many social receptions, the decor and atmosphere are just as important as the appetizers, drink and food being served. The wine and champagne must be served in appropriate stemware and the hors d'oeuvre or appetizer plates need to be attractive as well as functional.

At many receptions, people stand as they socialize with the stemware in one hand and the plate in the other hand. In order to eat the appetizers on the plate, most people have to find a table or counter to place the stemware down in order to free one hand. Needless interruptions in the flow of social conversations occur while the person leaves the conversation to look for a counter or table. More adventurous or coordinated people will attempt to hold both the plate and stemware adroitly in one hand in order to free the other hand for eating. As a result, needless and, embarrassing spills of wine and food occur.

Previously known plate and cup sets have attempted to solve the above mentioned problems by providing a cup receptacle in the plate. However, many previous plate constructions do not allow the plate to lay flat on a table surface while the stemware remains engaged in the receptacle. Other devices require specially adapted stemware to be used with the plate in order for the plate to function appropriately.

Previously known plate constructions also have problems in adequately seating champagne flute stemware. The receptacles are sized to receive and seat wider wine glasses and champagne glasses. Thin and upright flute stemware can pass vertically right through the receptacle in many plates. If the plate has a receptacle small enough to seat the tall upright flute stemware, the flute stemware can still be prone to tipping and spilling while housed in the receptacle.

What is needed is a plate that has a receptacle that is able to seat a variety of commercially available stemware. What is also needed is a plate that provides seating of the stemware into the receptacle while the plate is held and retains the stemware in the aperture while the plate is seated on a table. Furthermore, what is needed is a plate having a receptacle that can adequately seat champagne flute stemware and provide a shoulder that prevents undesirable tipping of the champagne flute.

SUMMARY OF THE DISCLOSURE

In accordance with one aspect of the invention, a plate and stemware set includes a plate member and a stemware. The plate member has a central portion with an upwardly facing flat surface. An upwardly extending periphery substantially surrounds the central portion. The periphery has a notch therein. The notch extends to an enlarged receptacle section of the plate defined in part by an aperture through the plate member, an upper rim about the aperture, a wall depending downwardly from the rim, and preferably a lower horizontal lip section about the aperture. The rim is positioned about the aperture and is coplanar with a top edge of the periphery of the plate. The downwardly depending wall connects the upper rim to the lower lip. The horizontally extending lip extends from the wall toward the center of the aperture. The lip and rim are preferably coaxial about a common central axis. The lip is preferably coplanar with the central portion of the plate.

The vertical distance between the rim and the lip preferably is substantially greater than the radial difference between the coaxial rim and lip such that the upper rim provides an anti-tipping guard shoulder for narrowly flared champagne flutes that are seated against the lower lip about the aperture.

The stemware member has a stem with a midsection sized to pass through the notch. The stem also preferably has a lower section sized greater than the diameter of the notch. The central portion of the plate has a base foot secured at its downwardly facing surface. The plate base foot has a height slightly greater than the thickness of a stem foot flange of the stemware to provide that the plate sits flat on a table surface and to elevate the lower edge of said vertical wall and lip above the stemware base foot flange. Consequently, the plate is able to sit flush on the flat table surface while the stemware is positioned through the aperture and also sits flat on the table surface.

The lower section of the stem is sized greater than the notch such that the wall at each side of the notch is laterally engageable against the lower stem section to resist the stemware from laterally exiting the aperture when the plate and stemware are both seated on the flat table surface.

Preferably, a vertically disposed wall extends from the periphery of the plate to the aperture on each side of the notch. Each wall has a canted lower edge extending downwardly from the periphery to the lower edge of the vertically disposed wall about the aperture to assist in guiding the stemware foot flange downwardly from the periphery and provide a tactile indication to a person to lower the stem to allow the stem midsection to pass through the notch and into the aperture.

BRIEF DESCRIPTION OF THE DRAWINGS

Reference now is made to the accompanying drawings in which.

DETAILED DESCRIPTION OF THE PREFERRED EMBODIMENT

Figure 1:
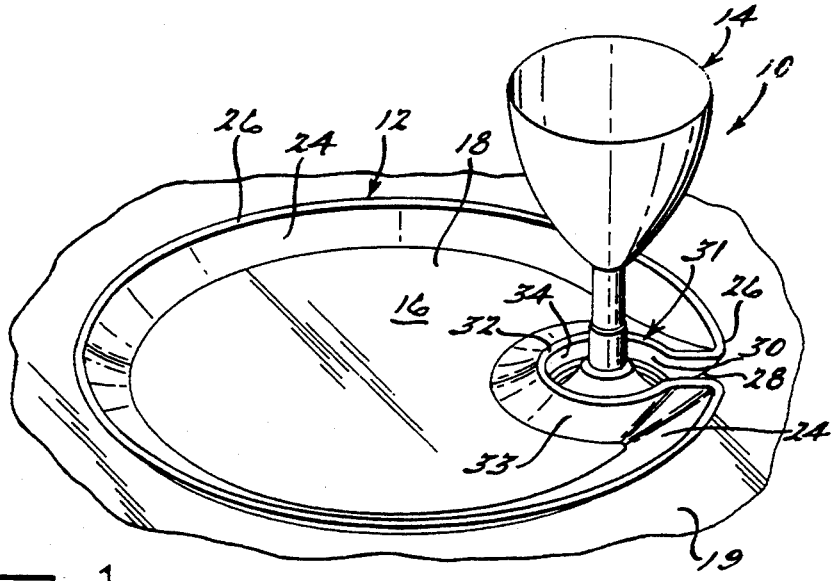
FIG. 1 is a top perspective view of a plate and stemware set illustrating one embodiment of the invention.
Figure 2:
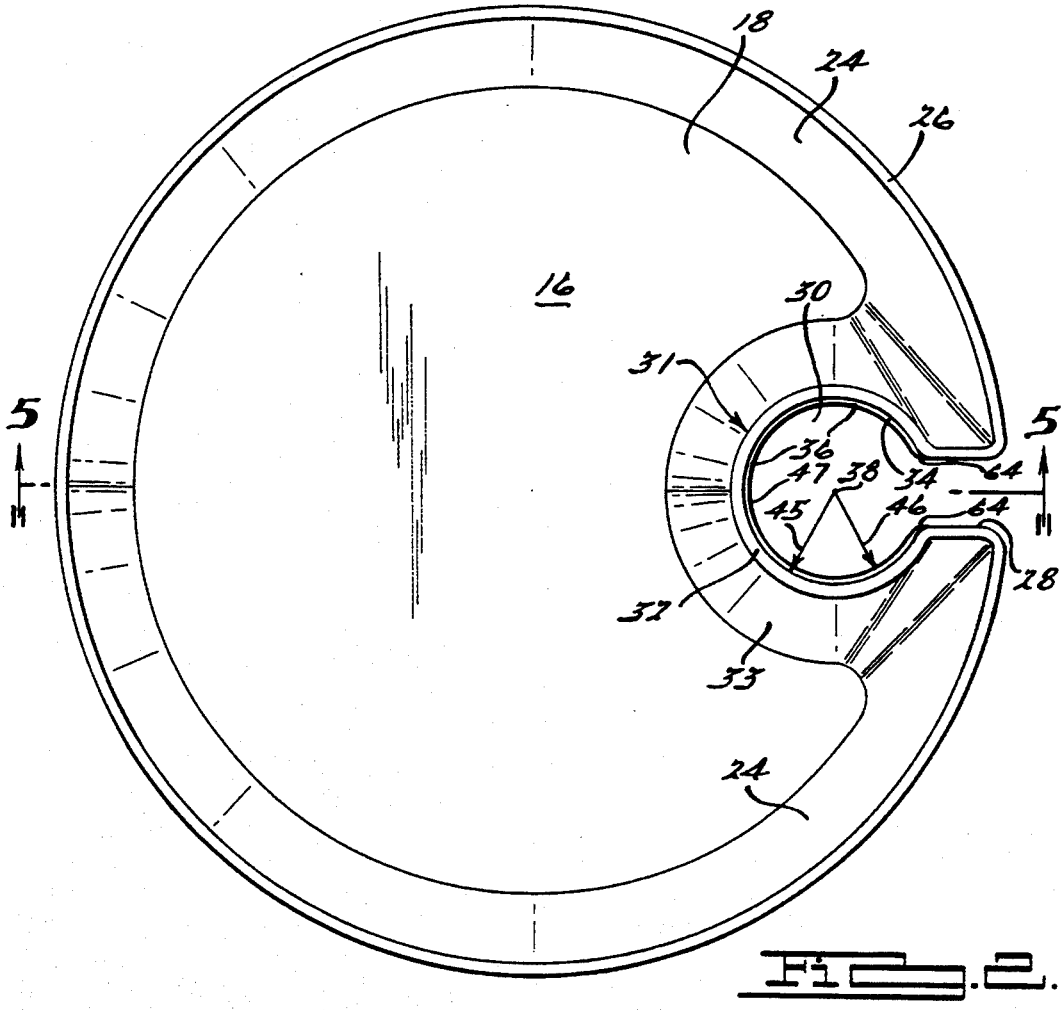
FIG. 2 is top plan view of the plate as shown in FIG. 1.
Figure 3:
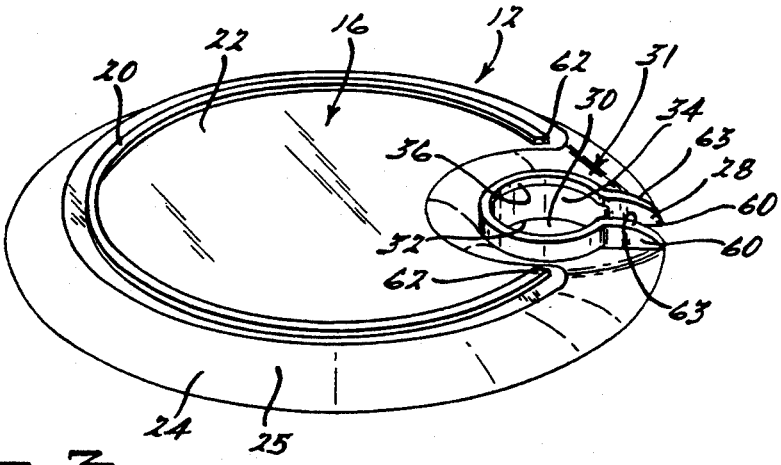
FIG. 3 is bottom perspective view of the plate as shown in FIG. 1.
Figure 4:
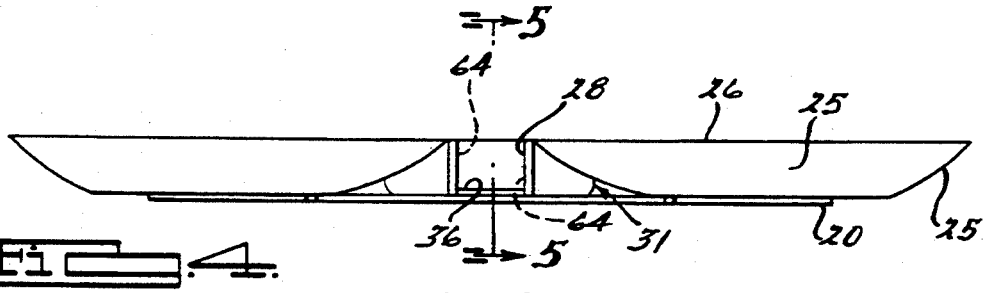
FIG. 4 is side elevational view of the plate shown in FIG. 1.

Referring now to FIGS. 1–3, a plate and stemware set 10 includes a plate member 12 and stemware 14. The plate 12 has a center portion 16 with a substantially flat upper facing surface 18 and a lower arcuate foot 20 depending from its lower surface 22 that sits on a table surface 19. A periphery 24 substantially surrounds the center portion 16 and is concavely contoured or dished and extends upwardly to an upper edge 26 as viewed from the upper surface as shown in FIG. 1. As viewed from the lower surface 22, the periphery 24 has a convexly sloped surface 25. The upper edge 26 forms a substantially convex outer contour for example, a substantial portion of a circle as illustrated in the top plan view in FIG. 2.

A notch 28 extends inwardly from the upper edge 26 of the periphery 24 to a receptacle portion 31 of the plate. The receptacle portion 31 includes aperture 30 extending through the plate 12. An upper rim 32 substantially surrounds the aperture 30. The rim 32 is coplanar with respect to the upper edge 26 of periphery 24. The plate is contoured about the rim 32 such that a periphery 33 about the rim is smoothly blended and contoured with both the periphery 24 and the upper surface 18 of center portion 16.

Figure 5:
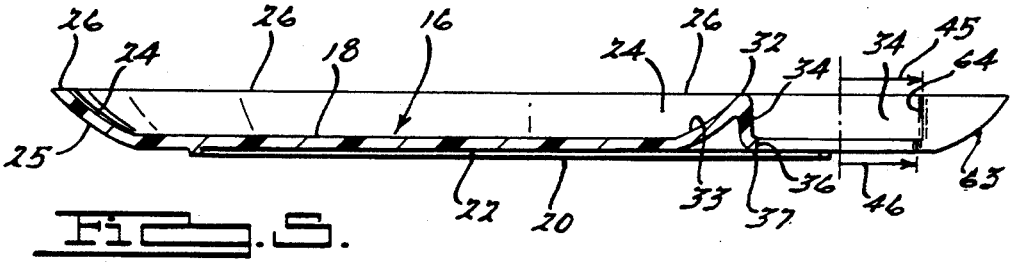
FIG. 5 is a cross sectional view taken along lines 5—5 shown in FIG. 2.

As clearly shown in FIG. 5, vertically disposed wall 34 depends downwardly from the rim 32. A horizontal lip 36 extends from the lower edge 37 of the depending wall 34 toward the central axis 38 of the aperture 30. The lip 36 is coplanar with the central portion 16. The lip 36 and rim 32 are coaxial about central axis 38.

Figure 7:
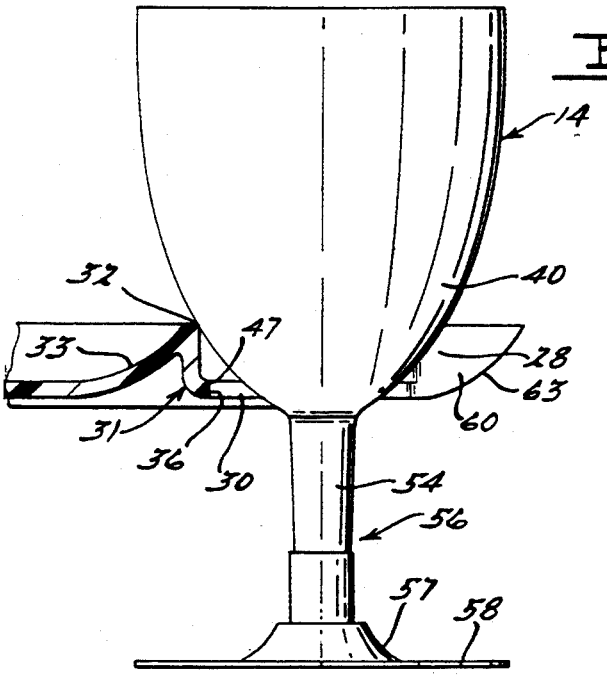
FIG. 7 is a fragmentary and partially segmented elevational view of a wine glass seated in the plate.
Figure 8:
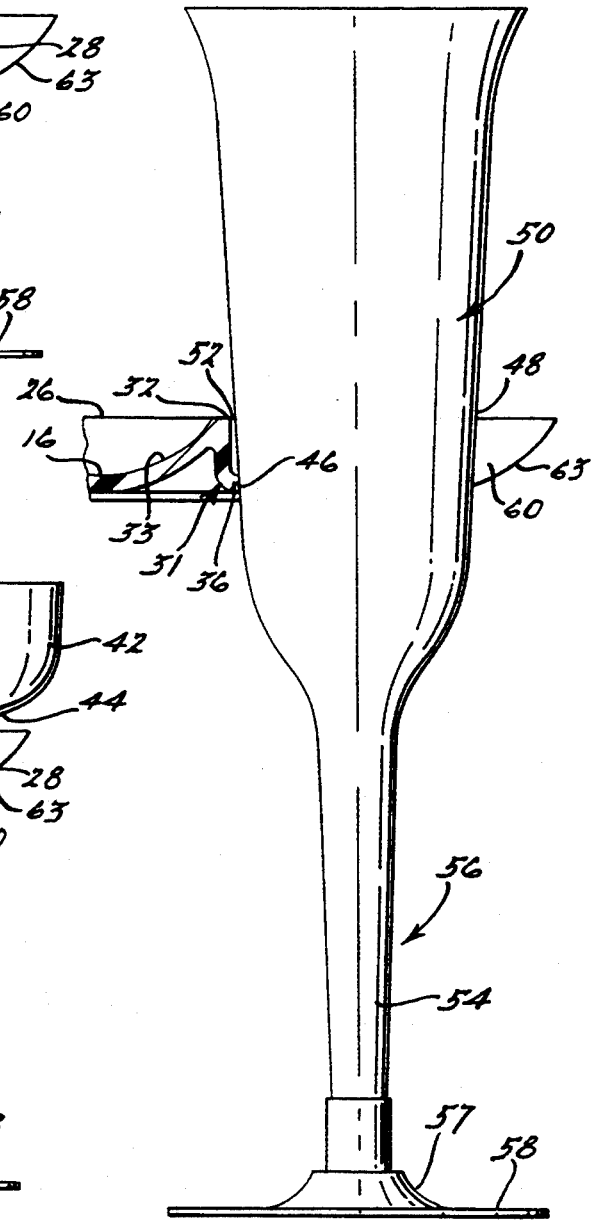
FIG. 8 is a view similar to FIG. 7 illustrating a champagne glass seated in the plate.

As shown in FIG. 7, the rim 32 is sized such that it seats and supports stemware 14 about the cup section 40. As shown in FIG. 8, the rim 32 is adapted to seat other stemware such as champagne glass 42 under its respective cup section 44. For more flared, i.e. wider, stemware 12 and 40, the rim 32 is used to seat the glass since the rim 32 forms a larger radius 45 than the lip 36 which forms smaller radius 46 to form a more stable receptacle 31.

Figure 9:
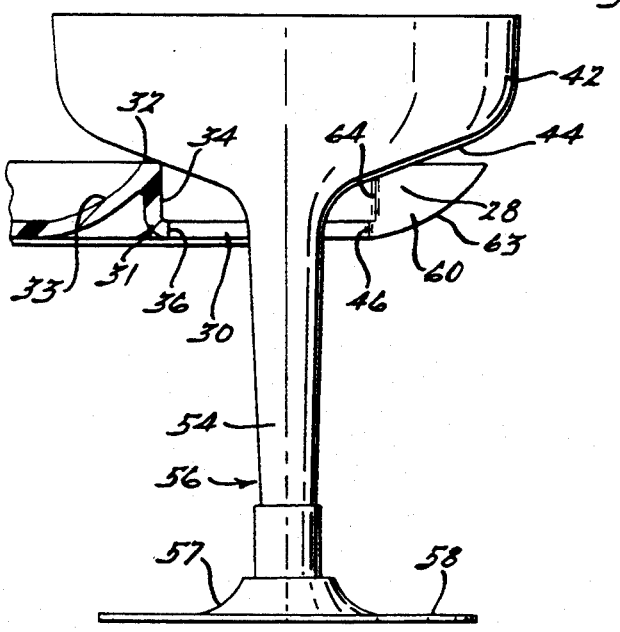
FIG. 9 is a view similar to FIG. 7 illustrating champagne flute stemware seated in the plate.

As shown in FIG. 9, the lip 36 has inner edge 47 appropriately positioned to engage and support a narrowly flared, i.e acutely tapered, cup section 48 of a champagne flute 50 since the lip 36 it has a smaller radius 46 than the upper rim 32. The vertical distance between the upper rim 32 and lower lip 36 is substantially greater than the difference between radii 45 and 46. In this fashion, when the flute 50 is seated against lip edge 47, the upper rim 32 then functions as a tilt guard to prevent the otherwise unstable flute stemware from tipping and spilling within receptacle 31. The rim 32 is coaxial with the lip edge 47 such that when the flute is properly seated against the lip edge 47 in an exact vertical direction, the rim 32 substantially surrounds the flute cup wall section 48 forming a uniform gap 52.

With all three stemware types 14, 42 or 50, when the respective stemware is seated in receptacle 31, the stemware extends through the aperture 30. Each of the stemware types 14, 42 and 50 are commercially available from a number of retail suppliers in clear disposable plastic material. The plate 12 may also be made from the same or similar plastic.

Figure 6:
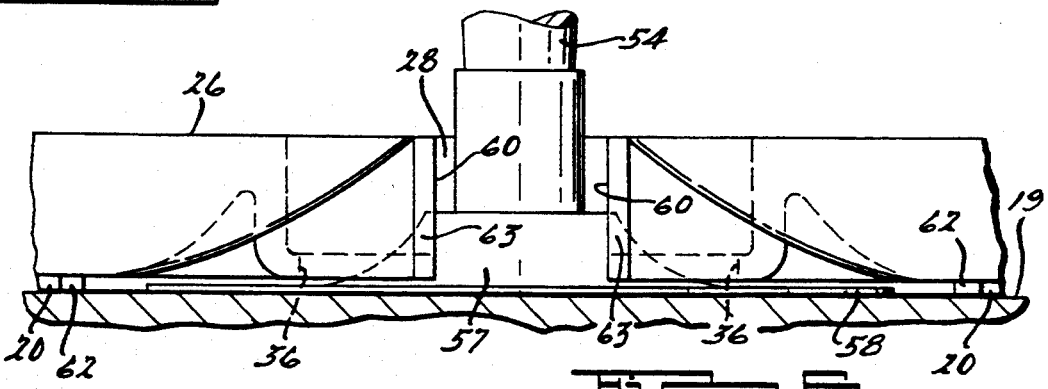
FIG. 6 is an enlarged fragmentary side elevational view similar to FIG. 4 illustrating the plate and stemware shown in FIG. 1.

As shown in FIG. 6, the lower arcuate foot 20 has a height greater than the thickness of flanged stem foot 58. The ends 62 of foot 20 is spaced away from the aperture 30 to allow the stem foot 58 to fit therebetween. The base foot 20 has a double function. Firstly, the foot 20 acts as a support for the plate and provides structural rigidity such that the plate remains stiff even if a person holds the plate at a single location at the periphery 26. The foot 20 also elevates the lip 36 above a table surface 19 when the plate is seated thereon. As such, the stem foot is interposed between the lip 36 and the table surface 19 while the plate sits flush and flat on table surface 19.

The notch 28 has a diameter sized to laterally receive and disengage the midsection 54 of stem 56 of the stemware. However, the lower portion 57 of stem 56 is constructed to be wider than midsection 54 and wider than notch 28. The portion 57 may be smoothly blended into foot flange 58. When the plate and stemware are seated on table surface 19, the lower portion 57 is locked within aperture 30. In other words, if the plate is pulled along table surface 19, the stemware 14, 42 or 50 will follow. Even if the plate is pulled away from the stemware such that the notch 28 is pulled against the stem, the edges 64 of vertically disposed wall 34 will interlock with the wider lower portion 58 and prevent the stemware from disengaging from the aperture 30 through notch 28. The stemware is interlocked in both the position shown in FIG. 6 and the seated positions shown in FIGS. 7–9. The stemware is disengageable from the plate when the cup section is lifted from the receptacle 31 and the narrow midsection 54 of the stem passes through the notch 28.

The sidewalls 60 at each side of notch 28 have a canted bottom edge 63 that extends downwardly from periphery 24 to lower lip 36. The angled bottom edge 63 assists guiding the stemware into the aperture. If the stemware is laterally moved to be placed into aperture 30 but is positioned too high with the stem foot flange 58 positioned above the lip 36 and below the upper edge 26, the stem foot 58 will abut the canted edge 63. Further lateral movement will automatically lower the stem foot flange 58 and give a tactile clue to the person to lower the stemware such that midsection 54 becomes aligned with the notch 28 to allow the stemware to pass therethrough and into aperture 30. Once the stemware passes through the notch 28, the stemware can then be easily seated in the receptacle 31.

The above described plate 12 and stemware 14 set allows for the plate 12 and stemware 14 to be set on a table ahead of time. The plate and stemware are presented as a set with both being flatly seated on a table surface 19. Secondly, the plate 12 allows a variety of stemware styles to be seated in the receptacle 31 in a stable fashion against tipping and spillage while the plate is held by a person. The seating of the stemware in the plate 12 allows a person to gracefully eat while standing during stand-up social receptions and other stand-up occasions.

Variations and modifications are possible without departing from the scope and spirit of the present invention as defined by the appended claims.

The embodiments in which an exclusive property or privilege is claimed are defined as follows:

1. A plate characterized by:

a central portion having a upwardly facing flat surface;

an upwardly extending substantially concavely dished periphery about said central portion;

said periphery having a notch therein sized to receive a stem of a stemware member having a stem base foot;

said notch extending to an enlarged aperture through said plate;

a rim positioned about the aperture and extending upwardly from said central portion in a concave manner and being coplanar with a top edge of said periphery of said plate;

a vertically depending wall extending downwardly from said rim about a substantial portion of said aperture;

said central portion having a base foot secured at its downwardly facing surface;

said foot having a height greater than the thickness of the stem base foot of said stemware to seat said plate flat on a table surface and to elevate a lower edge of said wall above said stemware base to allow said plate to sit flush on said flat table surface while stemware is positioned through said aperture and is also seated on said flat table surface.

2. A plate as defined in claim 1 further characterized by:

said base foot being arcuate and positioned near said peripheral portion;

the ends of the arcuate base foot being spaced from said aperture to allow space for the stemware foot flange.

3. A plate as defined in claim 2 further characterized by:

said rim about said aperture having a second periphery that is blended and smoothly contoured with the periphery of said plate and the upper facing surface of the center portion of said plate.

4. A plate as defined in claim 1 further characterized by:

the lower edge of said vertical wall having a horizontally extending lip, said lip extending toward the center of said aperture from said wall;

said lip being coplanar with said central portion.

5. A plate as defined claim 4 further characterized by:

said lip with its inner edge defining a first inner radius;

said rim forming a second inner co-axial radius that is greater than said first inner radius;

the vertical distance between said lower lip and said rim being substantially greater than difference between said first and second radii such that said rim forms an anti-tipping guard shoulder for champagne flute stemware.

6. A plate as defined claim 5 further characterized by:

said notch having a width that is narrower than the bottom portion of the stem of the stemware to laterally engage the bottom stem portion to prevent the stemware from laterally exiting the aperture when the plate and stemware are both seated on a table surface.

7. A plate as defined claim 6 further characterized by:

a vertically disposed wall extending from said periphery to said aperture on each side of said notch, said vertically disposed walls each having a canted lower edge extending downwardly from said periphery to said lower lip to assist in guiding said stemware foot from said periphery to a position below said lip to allow stemware to pass through said notch and into said aperture.

8. A plate as defined claim 4 further characterized by:

said notch having a width that is narrower than the bottom portion of the stem of the stemware to laterally engage the bottom stem portion to prevent the stemware from laterally exiting the aperture when the plate and stemware are both seated on a table surface.

9. A plate as defined claim 8 further characterized by:

a vertically disposed wall extending from said periphery to said aperture on each side of said notch, said vertically disposed walls each having a canted lower edge extending downwardly from said periphery to said lower lip to assist in guiding said stemware foot from said periphery to a position below said lip to allow stemware to pass through said notch and into said aperture.

10. A plate and stemware set, the set characterized by:

a plate member having a central portion with an upwardly facing flat surface, an upwardly extending periphery about said central portion, said periphery having a notch therein, said notch extending to an enlarged aperture through said plate member, a rim positioned about the aperture and extending upwardly from said central portion in a concave manner and being coplanar with a top edge of said periphery of said plate, a wall downwardly depending from said rim about a substantial portion of said aperture;

a stemware member having a cup section, a stem middle section with a diameter sized to pass through said notch, and a lower foot flange for seating the stem on a flat surface;

said central portion having a base foot secured at its downwardly facing surface with a height slightly greater than the thickness of the stem lower foot flange to seat said plate flat on a table surface and to elevate a lower edge of said vertical wall above said foot flange to allow said plate to sit flush on said flat table surface when the stemware is positioned through said aperture and said foot flange also is seated on said flat table surface.

11. A plate and stemware set as defined in claim 10 further characterized by:

said base foot being arcuate and positioned near said peripheral portion;

the ends of the arcuate base foot being spaced from said aperture to allow space for the stemware foot flange.

12. A plate and stemware set as defined in claim 11 further characterized by:

said rim about said aperture having a second periphery that is blended with the periphery of said plate and the upper facing surface of the center portion of said plate.

13. A plate and stemware set as defined in claim 10 further characterized by:

the lower edge of said downwardly depending wall having a horizontally extending lip, said lip extending toward the center of said aperture from said depending wall;

said lip being coplanar with said central portion and co-axial with said rim.

14. A plate and stemware set as defined claim 13 further characterized by:

said lip with its inner edge defining a first inner radius;

said rim forming a second inner co-axial radius that is greater than said first inner radius;

said stemware being a champagne flute with an acutely tapered exterior cup wall;

the vertical distance between said lower lip and said rim being substantially greater than difference between said first and second radii such that said rim forms an anti-tipping guard shoulder for said champagne flute stemware.

15. A plate and stemware set as defined claim 14 further characterized by:

said notch having a width that is narrower than the bottom portion of the stem of the stemware to laterally engage the bottom stem portion to prevent the stemware from laterally exiting the aperture when the plate and stemware are both seated on a table surface.

16. A plate and stemware set as defined claim 15 further characterized by:

a vertically disposed wall extending from said periphery of said plate to said aperture on each side of said notch, said vertically disposed walls each having a canted lower edge extending downwardly from said periphery to said lower lip to assist in guiding said stemware foot flange from said periphery to a position below said lip to allow stemware to pass through said notch and into said aperture.

17. A plate and stemware set as defined claim 13 further characterized by:

said notch having a width that is narrower than the bottom portion of the stem of the stemware to laterally engage the bottom stem portion to prevent the stemware from laterally exiting the aperture when the plate and stemware are both seated on a table surface.

18. A plate and stemware set as defined claim 17 further characterized by:

a vertically disposed wall extending from said periphery of said plate to said aperture on each side of said notch, said vertically disposed walls each having a canted lower edge extending downwardly from said periphery to said lower lip to assist in guiding said stemware foot from said periphery to a position below said lip to allow stemware to pass through said notch and into said aperture.

19. A plate characterized by:

a notch extending from an outer periphery of said plate to a stemware receptacle section through said plate member;

said receptacle section including an aperture through said plate, an upper rim positioned about the aperture and extending upwardly from said receptacle section in a concave manner, a wall depending downwardly from said rim about a substantial portion of said aperture, and a horizontally extending lower lip positioned at a bottom edge of said depending wall, said lip extending toward the center of said aperture from said wall and being substantially co-axial with said rim;

said lip with its inner edge defining a first inner radius;

said rim forming a second inner co-axial radius that is greater than said first inner radius;

the vertical distance between said lower lip and said upper rim being substantially greater than difference between said first and second radii such that said rim forms an anti-tipping guard shoulder for acutely tapered cup section of a champagne flute stem-ware when said stemware is seated in said receptacle by said lip.

20. A plate as defined claim 19 further characterized by:

a base foot secured at a downwardly facing surface of said plate;

said base foot being arcuate and positioned in proximity to an outer edge of said plate;

said base foot having a height greater than the thickness of a stem foot flange of said stemware to seat said plate flat on a table surface and to elevate said lower edge of said depending wall and lower lip above said stemware base to allow said plate to sit flush on said flat table surface while the stemware is positioned through said aperture and also is seated on said flat table surface; and the ends of the arcuate base foot being spaced from said aperture to allow space for the stemware foot flange.

* * * * *